US005653076A

United States Patent [19]

Habraken et al.

[11] Patent Number: 5,653,076

[45] Date of Patent: Aug. 5, 1997

[54] METHOD AND SYSTEM FOR ASSEMBLING A WALL

[75] Inventors: Nicolaas John Habraken, Cambridge, Mass.; Age Van Randen, Rotterdam, Netherlands; Franciscus Jacobus Maria De Vries, Delft, Netherlands; Joannes Cornelis Gerardus Maria Van Vonderen, Bergeyk, Netherlands

[73] Assignee: Infill Systems B.V., Delft, Netherlands

[21] Appl. No.: 374,730

[22] PCT Filed: Jul. 28, 1993

[86] PCT No.: PCT/NL93/00162

§ 371 Date: Mar. 16, 1995

§ 102(e) Date: Mar. 16, 1995

[87] PCT Pub. No.: WO94/02695

PCT Pub. Date: Feb. 3, 1994

[30] Foreign Application Priority Data

Jul. 28, 1992 [NL] Netherlands ..... 9201367
Oct. 19, 1992 [NL] Netherlands ..... 9201815

[51] Int. Cl.[6] ..... E04B 2/00

[52] U.S. Cl. ..... 52/481.2; 52/483.1; 52/489.1; 52/489.2; 52/745.09; 52/283.1

[58] Field of Search ..... 52/481.2, 481.1, 52/483.1, 489.1, 489.2, 238.1, 763, 745.09, 745.1

[56] References Cited

U.S. PATENT DOCUMENTS

| | | | |
|---|---|---|---|
| 3,034,609 | 5/1962 | Young | 52/481.1 X |
| 3,623,290 | 11/1971 | Downing | 52/481.2 |
| 3,922,764 | 12/1975 | Downing | 52/481.2 |
| 3,986,313 | 10/1976 | Nelsson . | |
| 3,998,018 | 12/1976 | Hodges | 52/481.2 |
| 4,094,114 | 6/1978 | Burcham | 52/481.2 |
| 4,255,910 | 3/1981 | Wendt | 52/481.2 |
| 4,263,764 | 4/1981 | Wendt | 52/481.2 |
| 4,312,158 | 1/1982 | Teli et al. . | |
| 4,408,427 | 10/1983 | Zilch | 52/481.2 |
| 4,471,593 | 9/1984 | Raglaud | 52/489.2 |
| 5,363,620 | 11/1994 | Liu | 52/483.1 X |

FOREIGN PATENT DOCUMENTS

| | | |
|---|---|---|
| 0243134 | 10/1987 | European Pat. Off. . |
| 2491524 | 4/1982 | France . |
| 552110 | 7/1974 | Switzerland . |
| 1125123 | 8/1968 | United Kingdom . |

*Primary Examiner*—Robert Canfield

[57] ABSTRACT

The invention relates to a method for assembling a wall (1) of a desired wall thickness from panels (2) and at least one stile (5) connecting the panels (2), comprising determining the dimensions of the connecting stile (5) in wall thickness direction and subsequently arranging at least one recess (3) receiving the connecting stile (5) in each of the panels (2) at a chosen distance (D) from the visible side (8) thereof, wherein the distance (D) from the visible side (8) is determined from the desired wall thickness and the determined dimensions of the stile (5) at the position of the join. The invention further relates to a system for assembling a wall (1) provided with at least two panels (2) each having at least one recess (3) at a determined distance (D) from their visible side (8), and at least one stile (5) having flanges (4) co-acting with the recesses (3) for mutually connecting the panels (2) and having determined chosen dimensions in wall thickness direction. The system and the method according to the invention make it possible during the construction of a wall to compensate tolerances in the dimensioning of the panels which occur during manufacture thereof, so that a wall results with precisely determined thickness and exceptionally flat visible side.

21 Claims, 12 Drawing Sheets

METHOD AND SYSTEM FOR ASSEMBLING A WALL

BACKGROUND OF THE INVENTION

The invention relates to a method for assembling a wall from at least two panels.

DESCRIPTION OF THE PRIOR ART

Such a method is known from the European patent specification 0 243 134, wherein oppositely located panels of a double system wall are joined by a stile and each of the thus joined panels is then attached to an adjoining panel by means of a tongue-groove connection. The adjoining panels are in turn then mutually joined by means of a connecting stile and the whole wall is built up in this way. For strengthening purposes the connecting stiles can be provided with a support flange which lies against the rear side of a panel facing the oppositely located panel.

The known method has the drawback that, as a result of tolerances during manufacture of the panels, tongues and grooves in different panels are often not located at the same distance from the visible side, whereby after assembly a wall results with irregular wall thickness. Such a wall required considerable finishing on the visible side to obtain a constant wall thickness. This same drawback also occurs in the assembly of the wall using the so-called "metal stud" system, wherein between the floor and ceiling of the space a metal framework is arranged against which panels are then screwed. Here also, when the rear side of the panels are located in one plane through connection to the framework, an irregular wall thickness will result as a consequence of manufacturing tolerances. In addition this method is highly labour-intensive and a wall erected in this manner is practically impossible to take down and move.

Finally, a method is known from the American patent specification 4,312,158 for assembling a wall, wherein oppositely located panels which are provided on either side with a recess arranged in their head end surface are arranged shifted in each case over a half panel width. The panels are connected by means of connecting stiles with a mirrored F-shape, both upper flanges of which engage into the recesses of two mutually adjoining panels, while both lower flanges lie against the rear side of these panels, and the leg is glued in the middle against the rear of an oppositely located panel. Also with this method the thickness of the wall will generally not be constant and finishing of the visible sides will be necessary on either side. In addition, due to the use of adhesive, a wall erected in such a way cannot be taken down and moved.

SUMMARY OF THE INVENTION

The present invention has for its object to provide a method of the above described type wherein these drawbacks do not occur. This is achieved according to the invention by a method comprising determining the dimensions of the connecting stile in wall thickness direction and subsequently arranging at least one recess receiving the connecting stile in each of the panels at a chosen distance from the visible side thereof, wherein the distance from the visible side is determined from the desired wall thickness and the determined dimensions of the stile at the position of the join. In this way the wall thickness is therefore determined from the inside, wherein it is also ensured that the visible side of the wall becomes precisely flat and indentations and protrusions at the position of the transition between two mutually adjoining panels are prevented.

The groove is preferably first arranged in the panel in each case after manufacture thereof. Irregularities resulting from manufacturing tolerances can thus be corrected in simple manner.

A simple method of obtaining the desired distance between the recess and the visible side is achieved when the recess is arranged by a machining operation and during machining the visible side of the panel lies in each case against a support member of a machining device.

In order to obtain a wall having (particularly bending) stiffness, the flange of the connecting stile is preferably fixed in lengthwise direction of the recess. This is achieved in simple manner if the recess is a groove and the flange is provided with at least one protruding portion which comes into engagement with a groove side wall during sliding of the flange into the groove. Another simple fixation method consists of the flange being provided with at least one opening, and adhesive being applied therein before sliding of the flange into the groove in order to a form an adhesive bridge extending through the opening and mutually joining oppositely located groove side walls.

When the connecting stile takes a divided form and the stile parts are mutually joined after sliding into the recesses, the wall can be erected in extremely simple and rapid manner, whereby construction costs are low.

In preference the stile parts are snapped together. Without the use of tools and without performing fitting operations between the panels a robust connection is thus formed which is nevertheless relatively simple to release again and re-erect elsewhere.

If the stile parts are connected by arranging therebetween at least one connecting element, use can be made for the stile parts to be mutually joined of identical profiles instead of co-acting, for instance tongue/groove, profiles. The manufacturing costs of the stile parts are thus further limited.

In preference at least one of the stile parts has an upper half and a lower half, the length of each of which is at most equal to half the height of a standard room area, and the upper and lower half, after sliding into the panel while leaving free an interspace, are mutually connected by arranging therebetween a connecting element bridging the interspace. Sawing the stile parts to size on the construction site is hereby no longer necessary, whereby construction time and cost are further limited.

In order to fix the wall in a space, a plurality of connecting elements can be arranged, at least one of which is slidable parallel to the recesses and, after having been connected to at least one of the stile parts, can be pushed into a channel-like member arranged along a floor and/or ceiling of the space.

Prior to being connected to each other the panels are preferably raised to a desired height above a floor and at least one support part is then arranged in the space between the panel and the floor. When the panels are glued to each other, the panels are preferably moved during connecting of the stile parts such that head ends of the panels are held free of each other.

The invention further relates to a system for assembling a wall which is suitable for use with the above described method. According to the invention this is achieved with a wall system provided with at least two panels each having at least one recess at a determined distance from their visible side, and at least one stile having flanges co-acting with the recesses for mutually connecting the panels and having determined chosen dimensions in wall thickness direction.

Further preferred embodiments of the wall system according to the invention form the subject-matter of the dependent claims 14–29.

Finally, the invention also relates to a wall panel, connecting stile, connecting element and support part for use in the above described system.

BRIEF DESCRIPTION OF THE DRAWINGS

The invention is now elucidated in the light of a number of embodiments, wherein reference is made to the annexed drawing in which like components are designated with like reference numerals, and in which.

DESCRIPTION OF THE PREFERRED EMBODIMENTS

Figure 1:
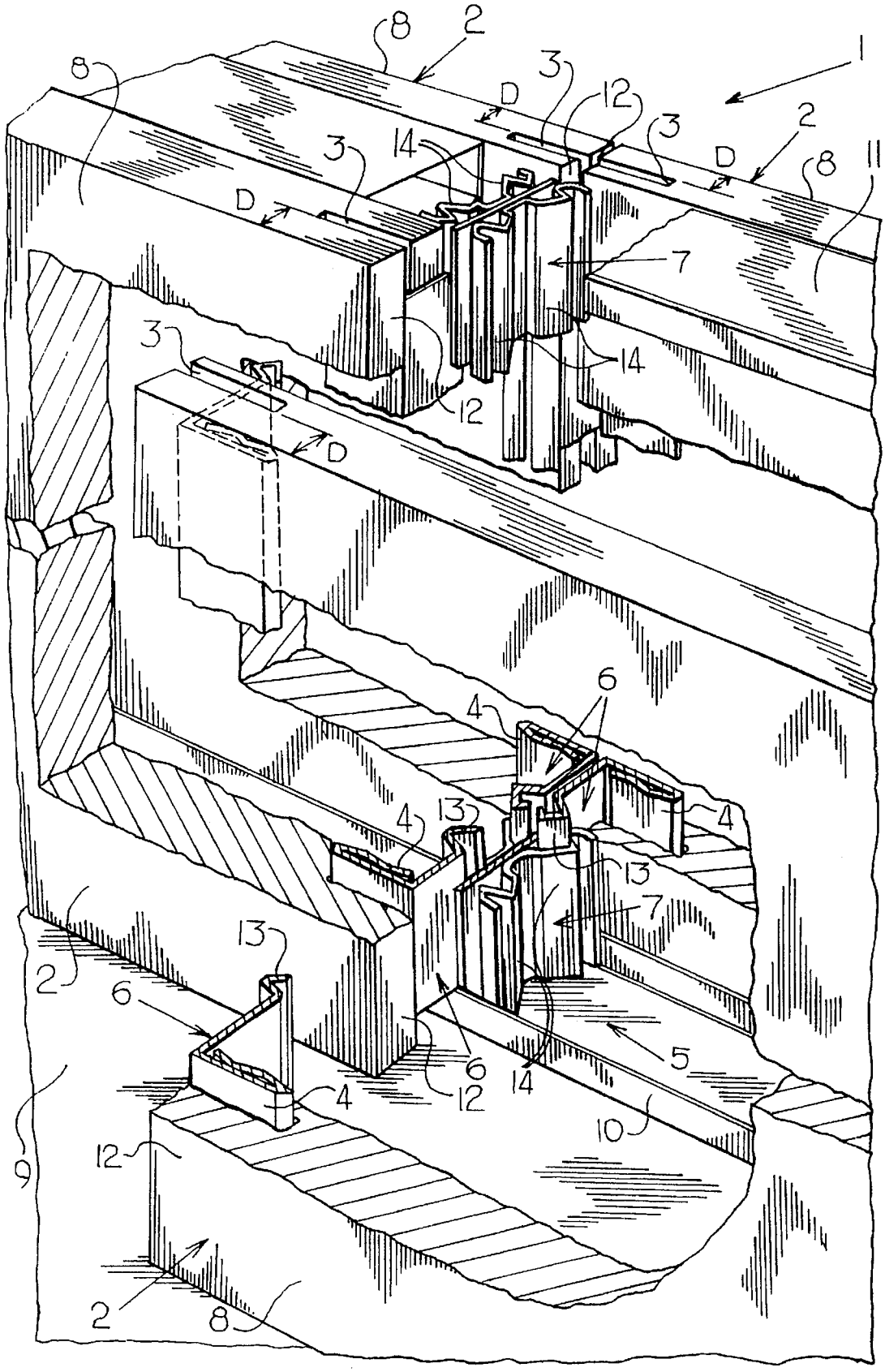
FIG. 1 shows a partly cut away perspective view of a wall with three panels connected by a first embodiment of the connecting element prior to installation of a fourth panel.

A wall 1 (FIG. 1) constructed according to the invention consists of a number of panels 2 each provided with a recess 3 which is arranged in their end surface 12 and in which engage flanges 4 of a stile 5 connecting the panels 2. In the embodiment shown the connecting stile 5 takes a divided form and the stile parts 6 are mutually joined by means of a coupling element 7 which is snapped together with the stile parts 6.

Recesses 3 are arranged at a distance D from the visible side 8 of panel 2 such that after mutual connection of the panels a flat wall is created with the desired wall thickness. This distance D is determined for this purpose on the basis of the desired wall thickness and the (precisely determined) dimensions of the connecting stile 5 in wall thickness direction. The system according to the present invention thus enables when the recesses 3 are arranged a full compensation of the manufacturing tolerances in the panels 2 which, depending on the materials used, can vary between ±0.1 mm and ±0.5 mm and which can thus result in differences of 0.2 to 1.0 mm on the visible side of the wall 1. The remaining tolerances in the wall thickness are then only the same as the manufacturing tolerances in the connecting stiles which will lie in the order of ±0.01 to ±0.05 mm.

In order to fix the wall 1 in a space, horizontal channel-like members 10, 11 are arranged along the floor 9 and the ceiling (not shown), the width of which channels is chosen such that the connecting elements 7 can be received fittingly therein. The width of connecting element 7 and therefore the channel-like member 10, 11 is generally so small that the rear of the panels 2 will not extend as far as the connecting element 7 and the channel-like member 10, 11, whereby finishing of this rear side will not be necessary. Moreover, panels 2 of different thickness can in this way be used without affecting the flatness of the visible side of the wall.

The join between the different stile parts 6 and the connecting element 7 is formed by a so-called snap coupling between chamfered hook portions 13 and the free outer ends of the stile parts 6 and chamfered hook portions 14 of the connecting element 7 co-acting therewith. To form the snap coupling the hook portions 13, the hook portions 14 or both hook portions must be resiliently flexible. The distance between hook portion 13 and flange 4 of each stile part 6 must be constant, as this distance determines whether the visible sides 8 of the panels 2 lie flush. Since the stile parts will in general be extruded, this distance is more easily controlled than the thickness of the panels 2, so that the system according to the invention forms in all circumstances a flat wall 1 of the desired thickness.

The snap coupling makes it possible to releasably connect the panels 2 to each other without the use of tools, wherein the join can futhermore be effected from outside and no holes therefore need be made in the panels 2.

The flanges 4 of stile parts 6 are clamped in the recesses 3 of panels 2 since they are manufactured from resiliently flexible material and, in the wholly non-tensioned state, occupy more space than is available in the recess 3.

Figure 2:
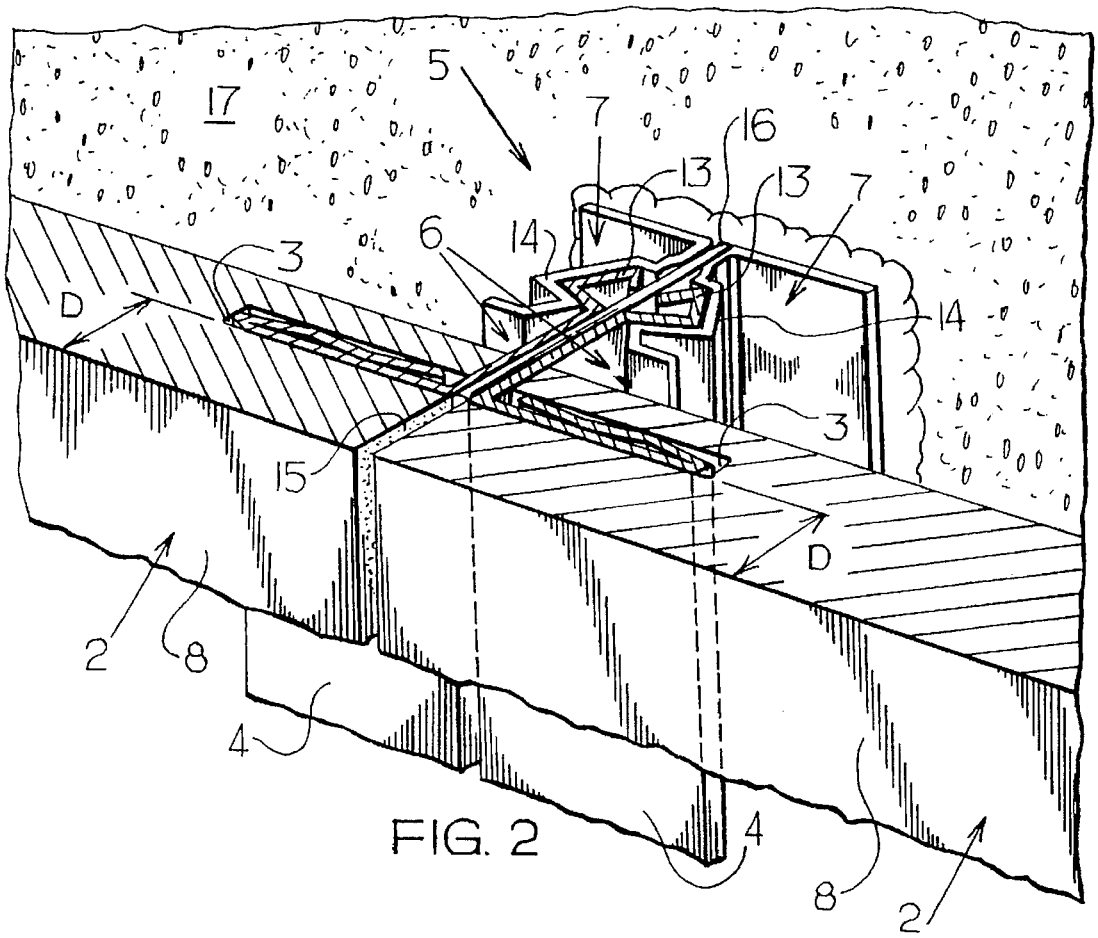
FIG. 2 is a sectional perspective view of two panels mutually connected according to the invention which are fixed against a structural wall by a second embodiment of the connecting element.

An adhesive layer 15 (FIG. 2) is further applied for connection between adjoining panels 2. If it will perhaps be necessary to disassemble the panels 2 at a later stage, it may be desirable to arrange a wire protruding under the panel behind the adhesive layer, with which wire the adhesive layer can be pulled loose. A body plate 16 as it were divides the connecting element 7 into separate compartments so that each hook portion 13 on the free outer end of a stile part 6 co-acts with a separate associated hook portion 14 of connecting element 7. In the shown embodiment the stile 5 connecting the panels 2 is otherwise fixed to a structural wall 17. In this case the channel-like horizontal members 11 and 12 can be omitted. It can in any case be clearly seen that the connecting element 7 does not lie against the rear of panels 2, and finishing or very precise dimensioning thereof is therefore not necessary.

Figure 3:
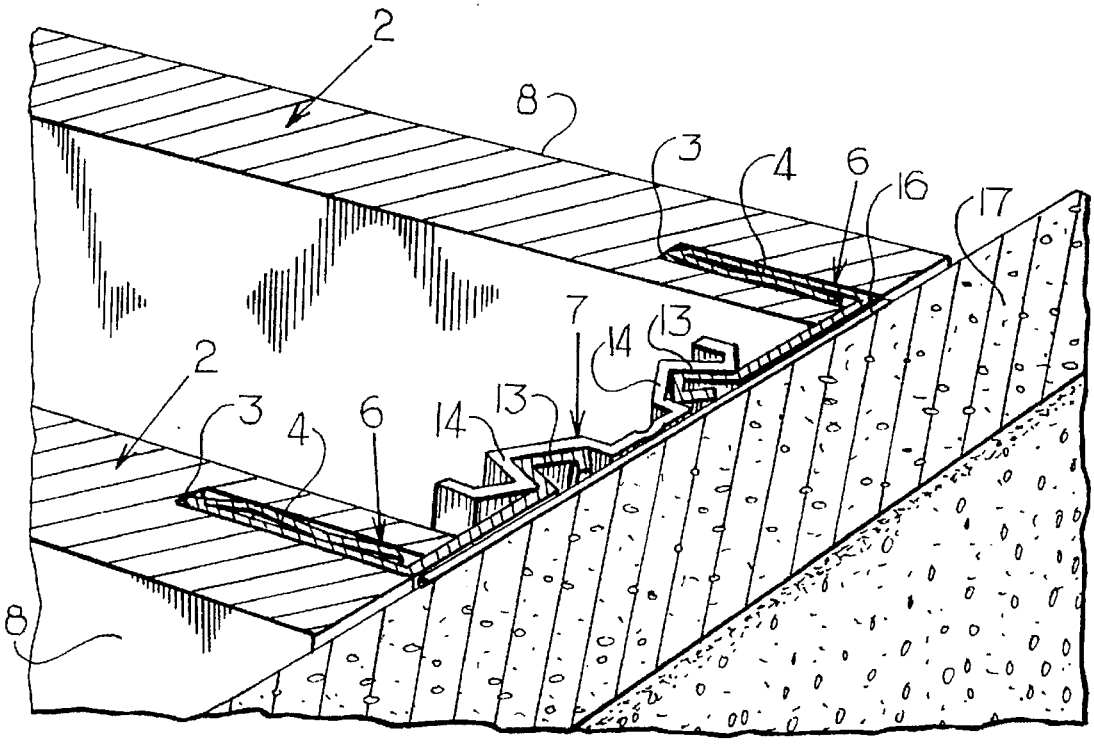
FIG. 3 is a sectional perspective view of an end surface connection of a wall according to the invention by a third embodiment of the connecting element.

In order to join wall panels 2 with their end face 12 to a structural wall 17 (FIG. 3), the body plate 16 of connecting element 7 can be fastened to the structural wall 17 by means of for instance screwing or glueing, whereafter the panels 2 are fixed releasably to the structural wall 17 by snapping the relevant stile parts 6 into connecting element 7.

Figure 4:
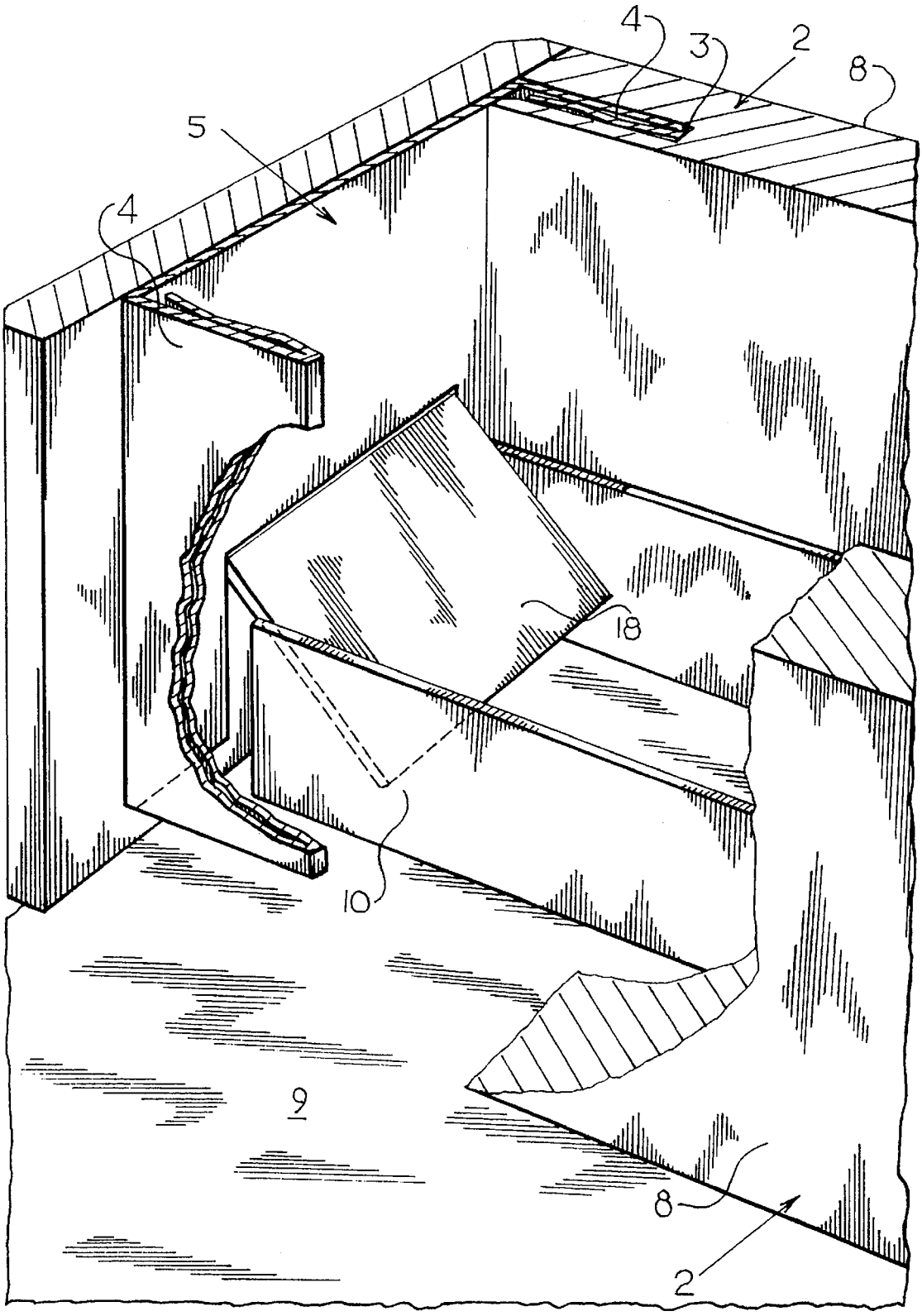
FIG. 4 shows a partly cut away perspective sectional view of the end surface connection of a wall system according to the invention with a connecting stile manufactured in one piece.

The connecting stile 5 can also take an integral form (FIG. 4). In this case fixing of the stile 5 in the channel-like members 10, 11 can take place by bending a portion of the stile 5 in order to thus form a flange 18 fitting into the channel.

Figure 5:
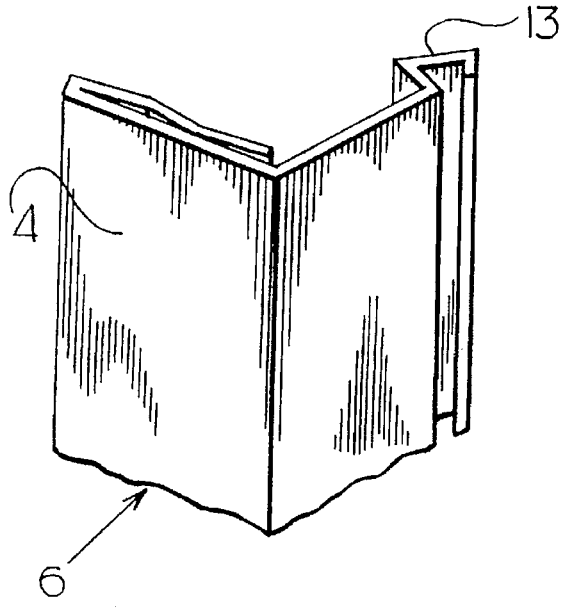
FIG. 5 shows a first embodiment of a connecting stile in divided form.
Figure 6:
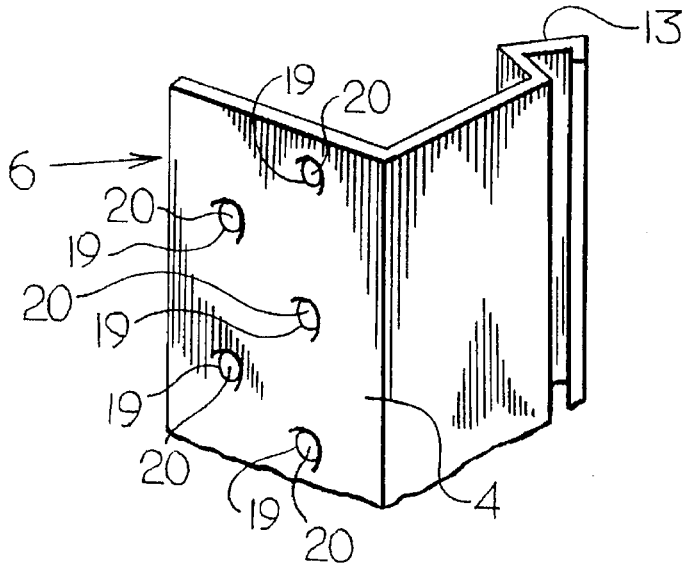
FIG. 6 shows a view corresponding with FIG. 5 of a second embodiment of the connecting stile.
Figure 13:
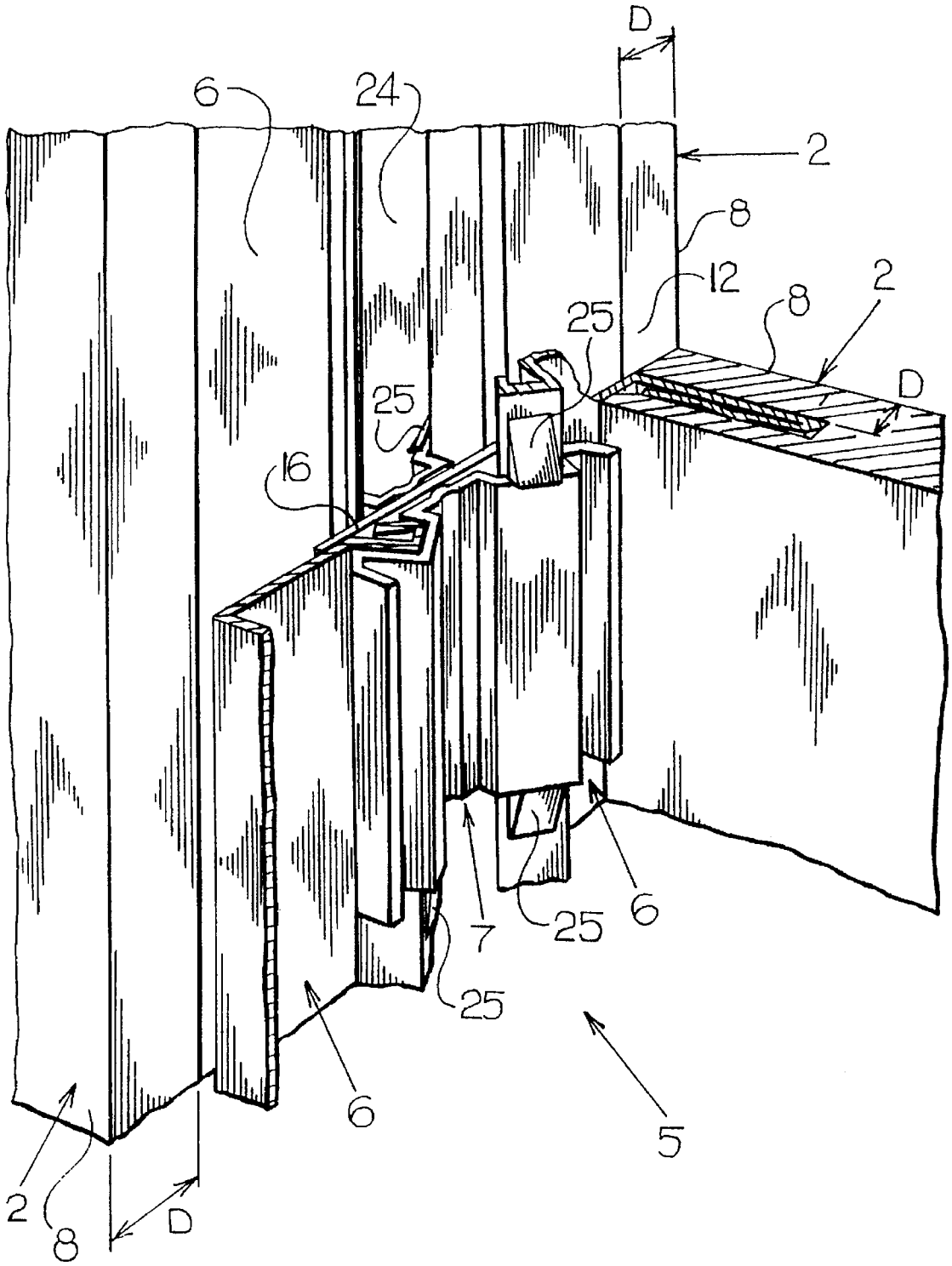
FIG. 13 is a partly cut away perspective view showing the non-slidable fixing of a connecting element to connecting stile parts.
Figure 14:
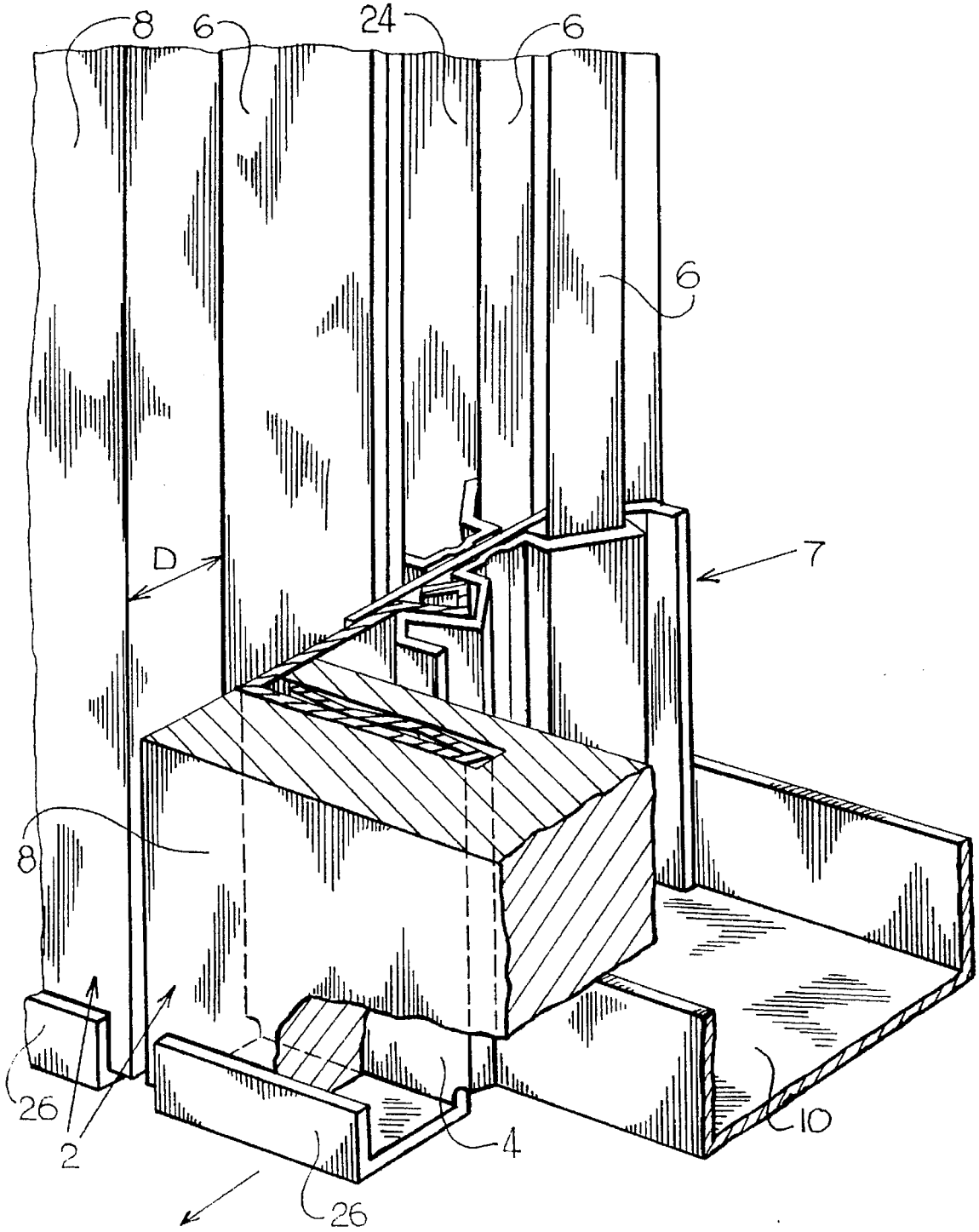
FIG. 14 is a partly cut away perspective view showing a release lip arranged on a connecting stile part.
Figure 15:
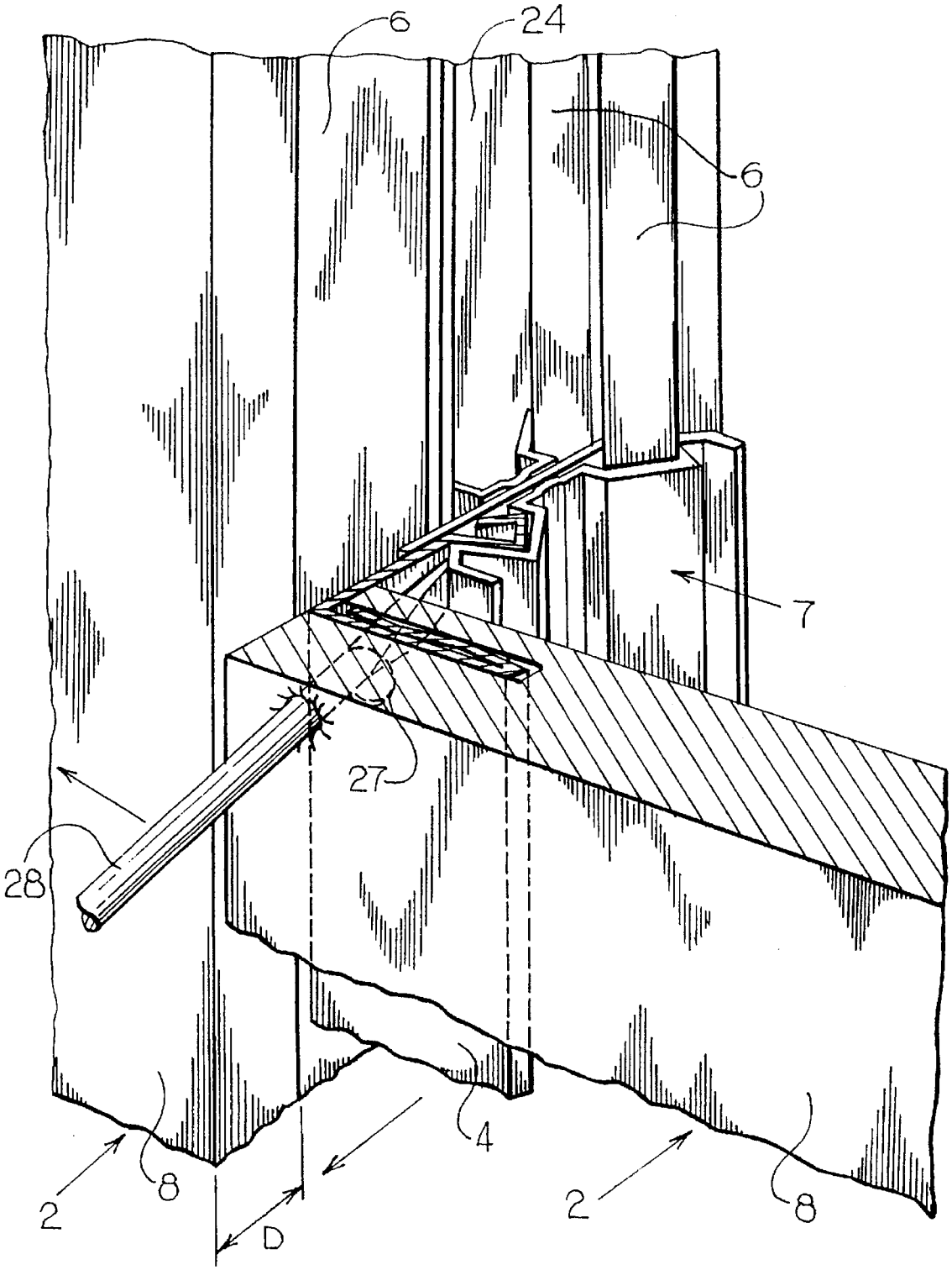
FIG. 15 is a partly cut away perspective view showing release using a tool.

As stated above, the connecting stile 5 can be constructed from stile parts 6. Each stile part can then be fixed for instance by clamping into a recess 3 of a panel 2. For this purpose the leg of the L-shaped stile part 6 forming the flange 4 can for instance be bent over and in non-tensioned state occupy a larger space than the width of the recess 3 (FIG. 5). In this manner a connection is formed that is simple to mount and release. The stile part 6 can also be fixed in lengthwise direction of the recess 3. This can be done for instance by adapting the dimensions of the leg of the L-shaped stile part 6 forming the flange 4 to those of the recess 3 and by subsequently providing the flange 4 with gripping parts 19 protruding outside its plane, for instance in the form of the sharp edges of holes 20 arranged in flange 4 (FIG. 6). When the stile part 6 is pushed into the recess 3 secondary recesses running in transverse direction of recess 3 are formed in the recess side wall which permit sliding of the stile part 6 in and out of the recess 3 but which make a movement of stile part 6 in lengthwise direction of recess 3 impossible. In this way the stiffness, particularly against deflection of the wall 2, is further increased, in particular when the connecting elements 7 are also arranged in non-slidable manner on the stile parts 6 (FIG. 13). It is also possible to provide the end edge of flange 4 with protruding portions, thus forming a milled edge.

Figure 7:
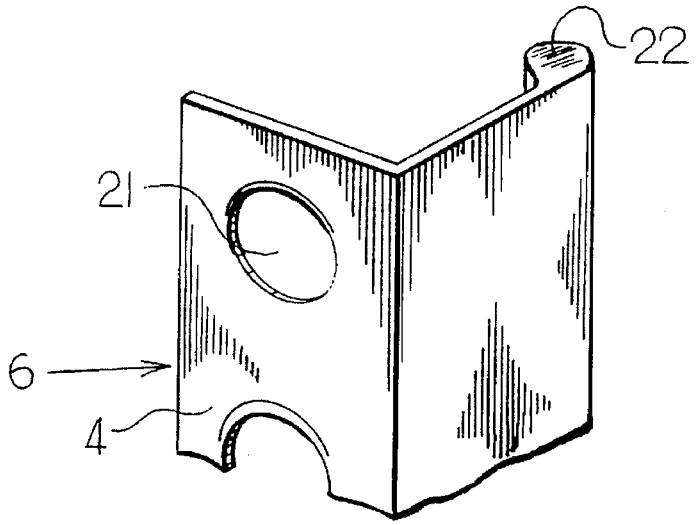
FIG. 7 depicts a third embodiment of the stile.

The stile part 6 can also be fixed in recess 3 by arranging openings 21 in the flange 4 (FIG. 7) and by filling the recess 3 with adhesive prior to insertion of a stile part 6. The adhesive will then form adhesive bridges protruding through openings 21, whereby a very firm fixing of the stile part 6 in recess 3 is obtained. Release of stile part 6 then of course becomes correspondingly more difficult. Instead of the chamfered hook portion 13 it is of course also possible to select another form of the snap coupling, for instance a semi-spherical curled edge 22. It is evident that the configuration of the connecting element 7 must here also be adapted.

It is otherwise of course also possible that stile parts 6 arranged in the different panels 2 have complementary configurations, whereby the stile parts 6 can be connected directly to each other to form a single connecting stile 5, and no connecting elements 7 are required.

Figure 8:
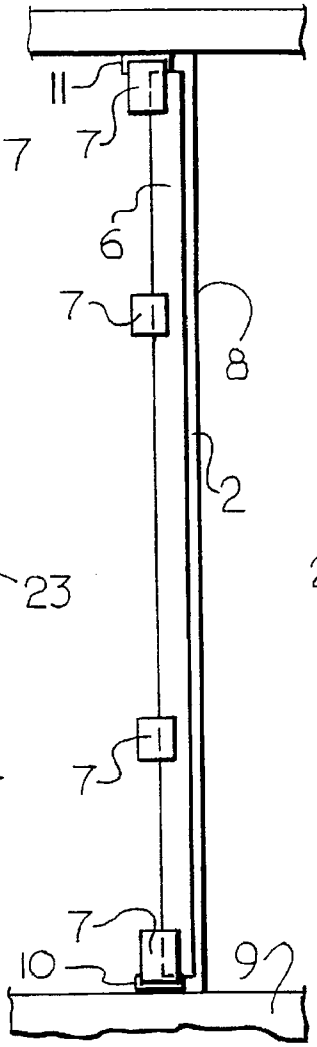
FIG. 8 shows a schematic view of a connecting stile in divided form and connecting elements arranged thereon.

The dimensions of each connecting element 7 in lengthwise direction of recess 3 are considerably smaller than those of the stile parts 6 (FIG. 8). After being snapped onto one or more stile parts 6 the connecting elements 7 can therefore be slid in lengthwise direction of the recess 3 to an optimal position for the connection between oppositely located wall panels 2. Because connecting elements 7 are thus not present over the full height of the panel 2 and because the connecting elements 7 are formed such that stile parts 6 of opposite panels 2 do not make mutual contact, spaces 24 are left in the wall 1 between the connecting elements 7 and the stile parts 6 of opposite wall panels 2, wherethrough cables and leads can be fed (see also FIG. 1, 13, 14, 15).

Figure 11:
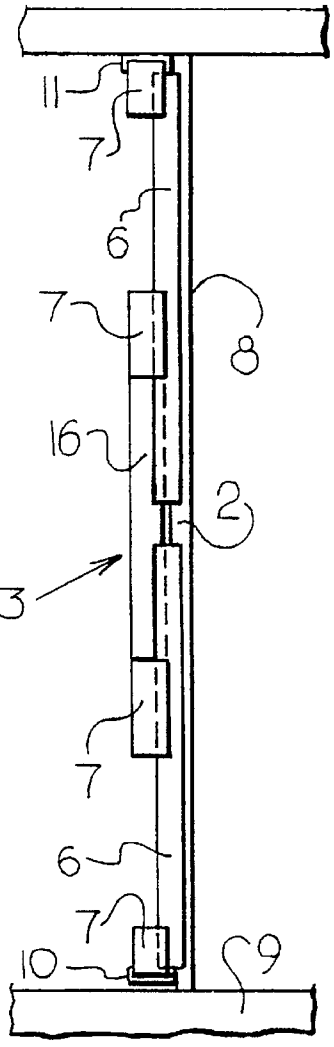
FIG. 9, 10 and 11 shows views corresponding with FIG. 8 in which alternative embodiments of the connecting elements are depicted.
Figure 10:
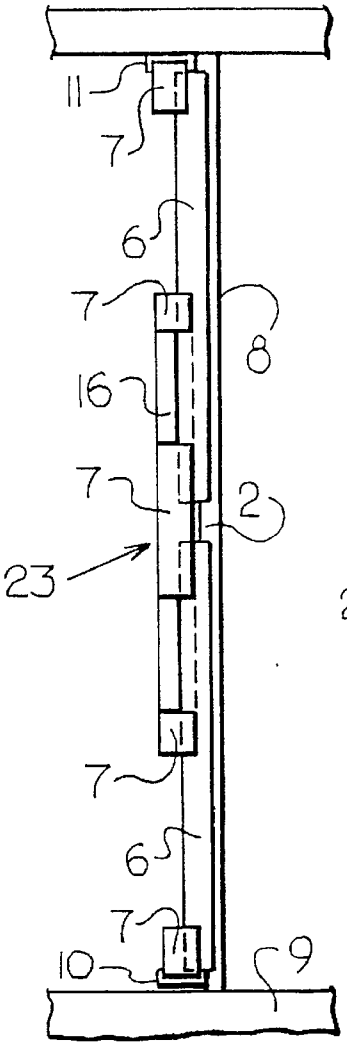
Figure 9:
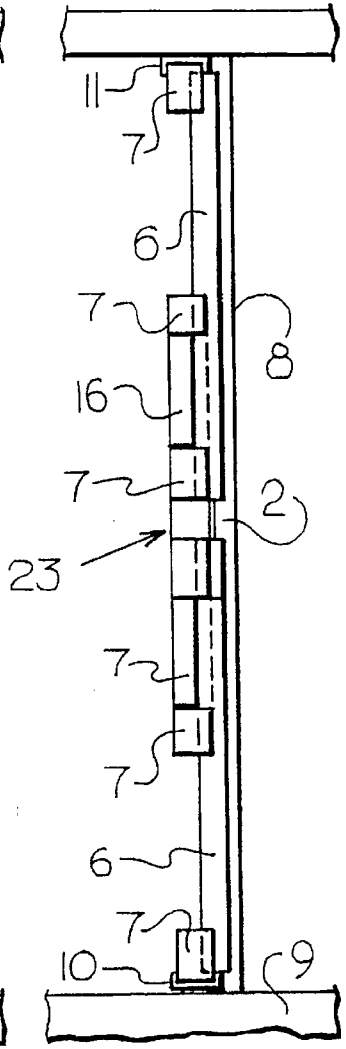
Figure 12:
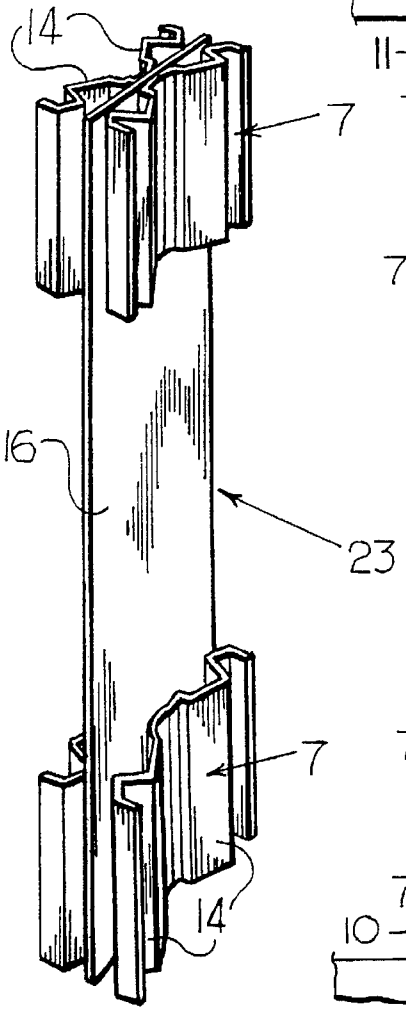
FIG. 12 is a perspective view of the connecting element shown in FIG. 11.

Instead of using stile parts 6 which extend over practically the whole height of the wall 1 and therefore have to be sawn to size during construction, use can also be made of shorter stile parts 6. When stile parts 6 are used of a length which is smaller than half the minimum anticipated room height, these stile parts 6 never require sawing, which increases fitting speed and reduces the forming of waste. It is advantageous in this case also to mutually connect the stile parts 6 placed one above another in the same recess 3, for instance by means of a combined connecting element 23. The combined connecting element 23 consists of a number of connecting elements 7 with one common body plate 16 (FIG. 12). Different arrangements of the connecting elements 7 over the common body plate 16 are conceivable depending on the mutual distance between the stile parts 6 place one above another and the strength and stiffness requirements made of the wall 1 (FIG. 9, 10 and 11). As already indicated above, the upper and lower connecting element 7, after being connected to one or more stile parts 6 (but before placing of the last of the panels 2 to be joined by the connecting elements 7), are pushed up or downward along the connecting stile 5 into the associated channel-like member 11 or 10 respectively. In this way the wall 1 is fixed in the room area. It is also conceivable that the combined connecting element 23 extends along practically the entire height of the wall and is placed between the channel-like members 10, 11 before the wall panels 2 are arranged.

Instead of the embodiment of the connecting elements 7, 23 shown, wherein the hook portions 14 are arranged on the body plate 16, it is also possible to punch the hook portions 14 from the body plate 16. The hook portions 14 protruding on oppositely located sides of body plate 16 are then of course arranged displaced in lengthwise direction of the connecting element 7.

As stated, the connecting elements 7 can however also be arranged non-slidably on the stile parts 6 by means of fastening ridges 25 (FIG. 13) for further strengthening of the wall. It can be clearly seen here how the connecting element 7 and the stile parts 6 form a horizontal passage 24 for cables, leads and the like. Instead of the shown connecting element 7 with body plate 16, a connecting element can otherwise also be used without body plate. In that case two stile parts 6 are slid in each case into one compartment of the connecting element 7 bounded by hook portions 14. During construction of the wall 1 adjoining panels 2 must in that case first be mutually connected by means of a connecting element 7, whereafter the two opposite panels 2 are snapped simultaneously from the other side into the connecting element 7.

In order to be able to disassemble a wall 1 constructed according to the invention one of the stile parts 6 can have a release lip 26 which extends on the underside of the relevant panel 2 beyond the visible surface 8 thereof. By pulling on this lip 26, which normally after placing of wall 1 is removed from sight by laying a skirting (not shown), the associated stile part 6 can be successively pulled loose from the different connecting elements 7. Access is thereby then acquired to the connecting elements 7, whereafter the lower and upper connecting element 7 can be pushed respectively up and downward and the wall 1 further disassembled by snapping loose.

Alternatively it is also possible to arrange pre-drilled holes 27 at regular distances in the flange 4 of one of the stile parts 6, whereafter during disassembly of the wall 1 a hole has only to be arranged in panel 2 in the correct position, whereafter the stile part 6 provided with holes 27 can be snapped loose from a first connecting element 7 using tool placed through the hole in the panel 2 and the hole 27 in the flange 4, for instance a screwdriver 28. Space is thereby created to grip behind the panel 2 and pull it loose from the other connecting elements 7, after which the wall 1 can be disassembled.

Figure 16:
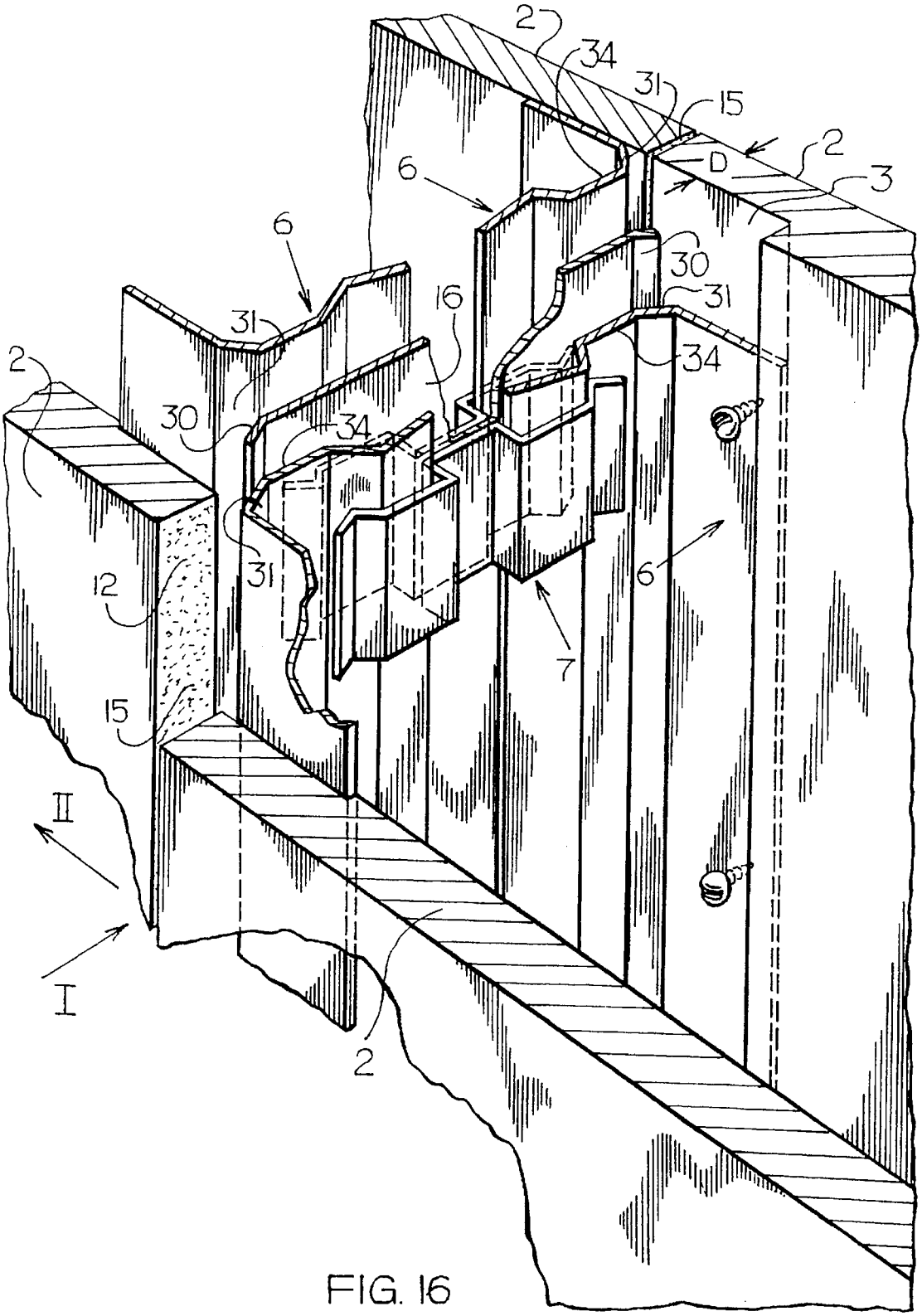
FIG. 16 shows a partly cut away perspective view of an alternative embodiment of the connecting stile according to the invention.

When the body plate 16 of connecting element 7 has a protruding guide strip 30 (FIG. 16), and the stile parts 6 each comprise a recessed guide portion 31 co-acting therewith, a subsequent adjoining panel 2 is placed each time according to the arrows I, II against the preceding wall panel 2 during assembling of the wall. The end wall sides 12 of the panels are thus held free of each other during the sliding movement transversely of the wall direction (arrow I) by co-action of the guide strip 30 and a wall portion 34 of stile part 6, so that an adhesive layer 15 present on the end wall side 12 is not scraped therefrom. When the wall panel 2 is pushed further the strip 30 falls into the recess 31 of stile part 6, whereby the panel 2 is moved in the direction of the arrow II and placed close-fittingly against the adjoining panel.

It can also be clearly seen in this figure how, using the system of dimensioning from the inside, a wall 1 of a desired wall thickness can be erected from panels 2 of very varying thicknesses by arranging the recesses 3 such that the sum of the remaining panel thicknesses D and the dimensions of the stile part 5 in wall thickness direction is equal to the desired wall thickness.

Figure 17:
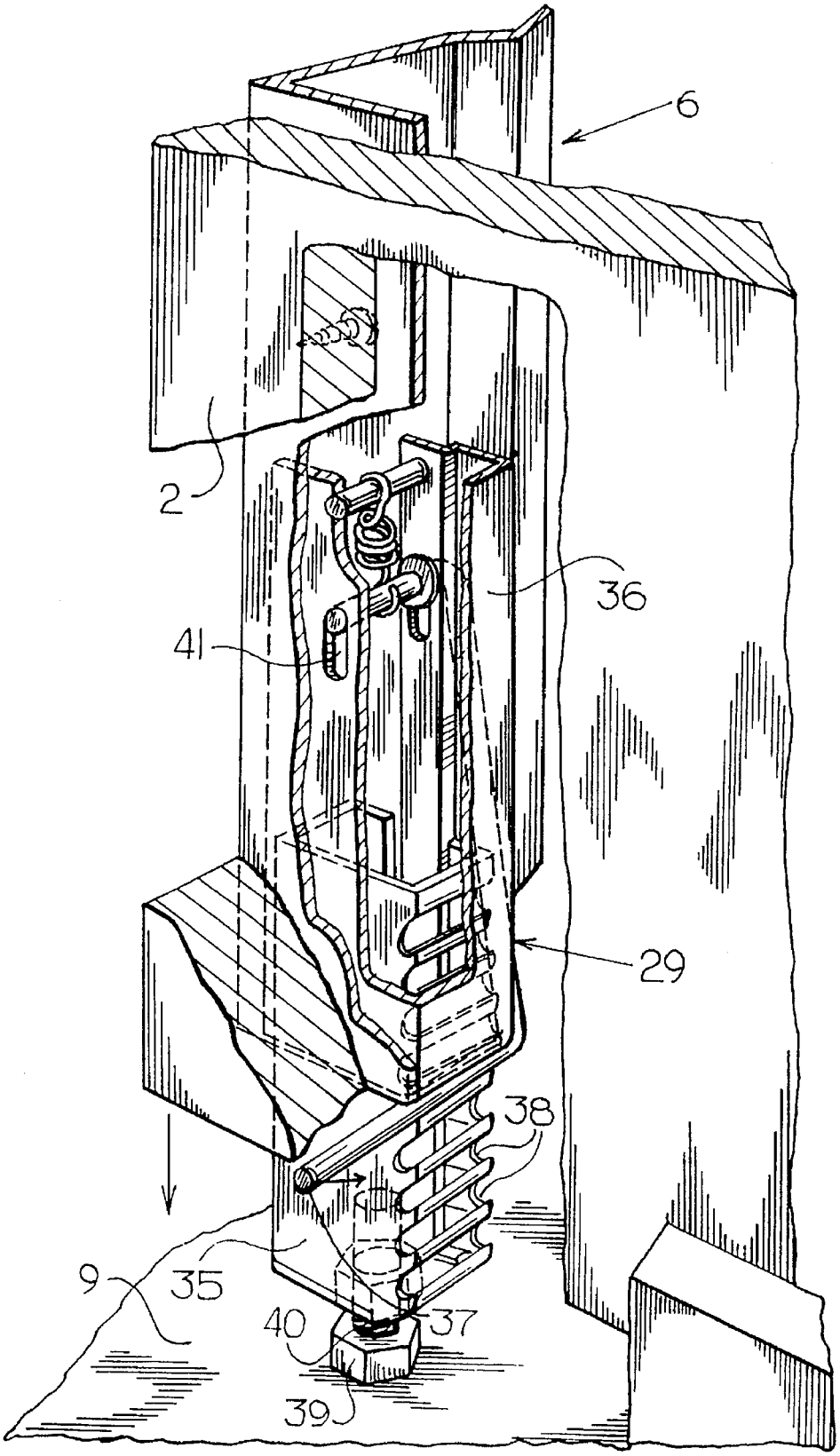
FIG. 17 shows a partly cut away perspective view of a first embodiment of a support part according to the invention in partially extended situation.

Each wall panel 2 can be provided with one or more support parts 29 (FIG. 17) which ensure a desired height of the panel 2 above the floor 9. Support part 29 comprises an inner section 35 which is arranged slidably in an outer section 36 fixed on the wall panel 2. Outer section 36 is provided with a pivotable hooking arm 37 which can be placed in engagement with one of the adjusting openings 38 arranged sloping upward in inner section 35. Due to the orientation of these openings 38 the hooking arm 37 is enclosed therein by the weight of the wall panel 2. An adjustment bolt 39 is also arranged for precise adjustment of the height of wall panel 2 above the floor 9.

Figure 18:
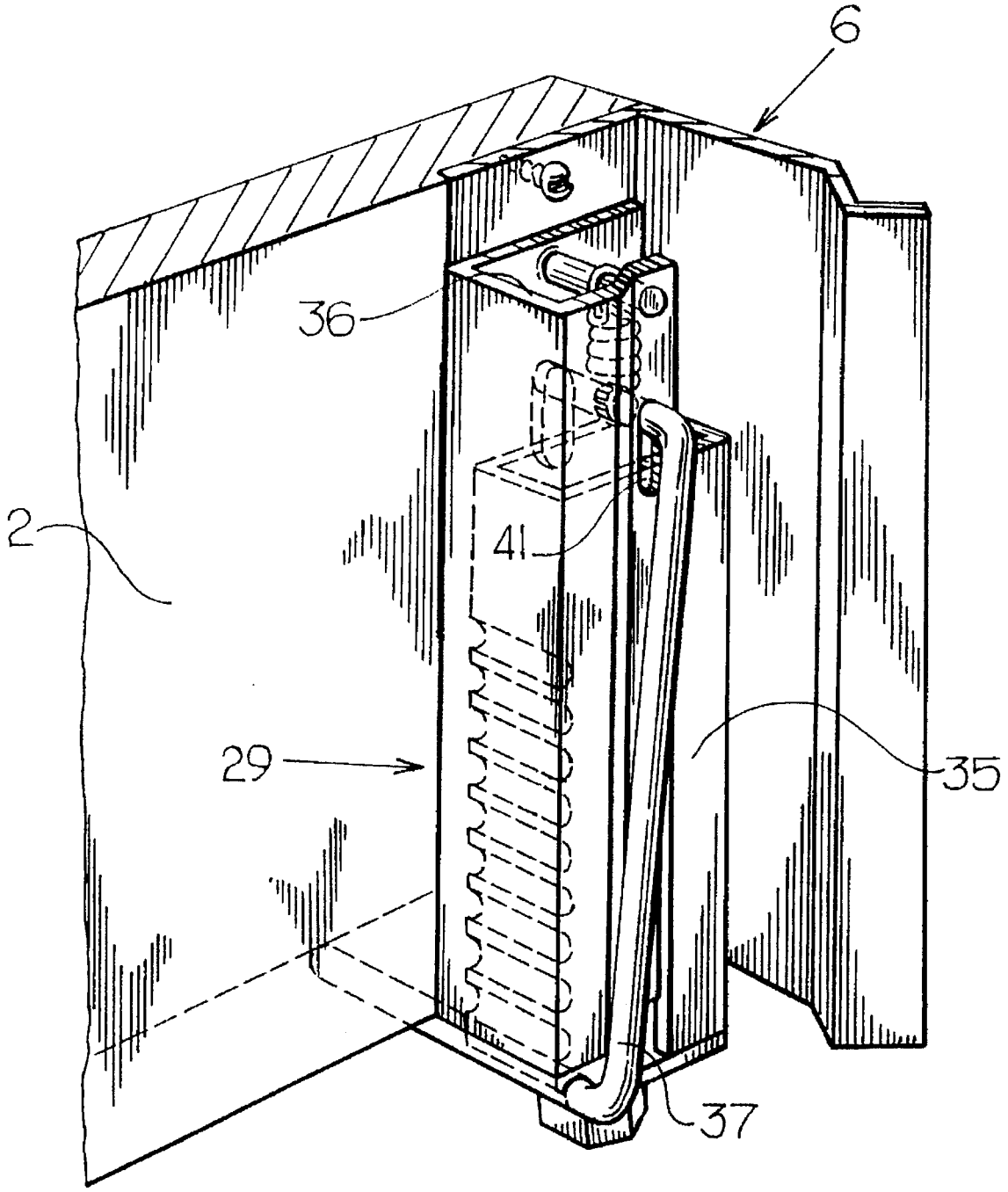
FIG. 18 is a perspective view of the support part shown in FIG. 17 in collapsed situation.

The inner section 35 has on the underside a downward oriented locking opening 40 into which the hooking arm 37 engages during transport (FIG. 18). For this purpose the hooking arm 37 is connected at 41 to the outer section 36 for limited sliding with interposing of biasing means, for example a spring 42 or a simple elastic band.

Figure 19:
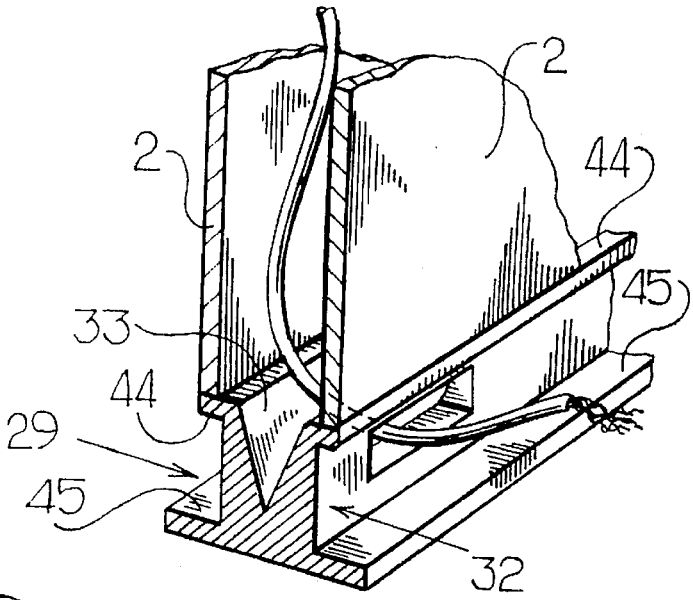
FIG. 19 shows a partly cut away sectional perspective view of a second embodiment of the support part.
Figure 20:
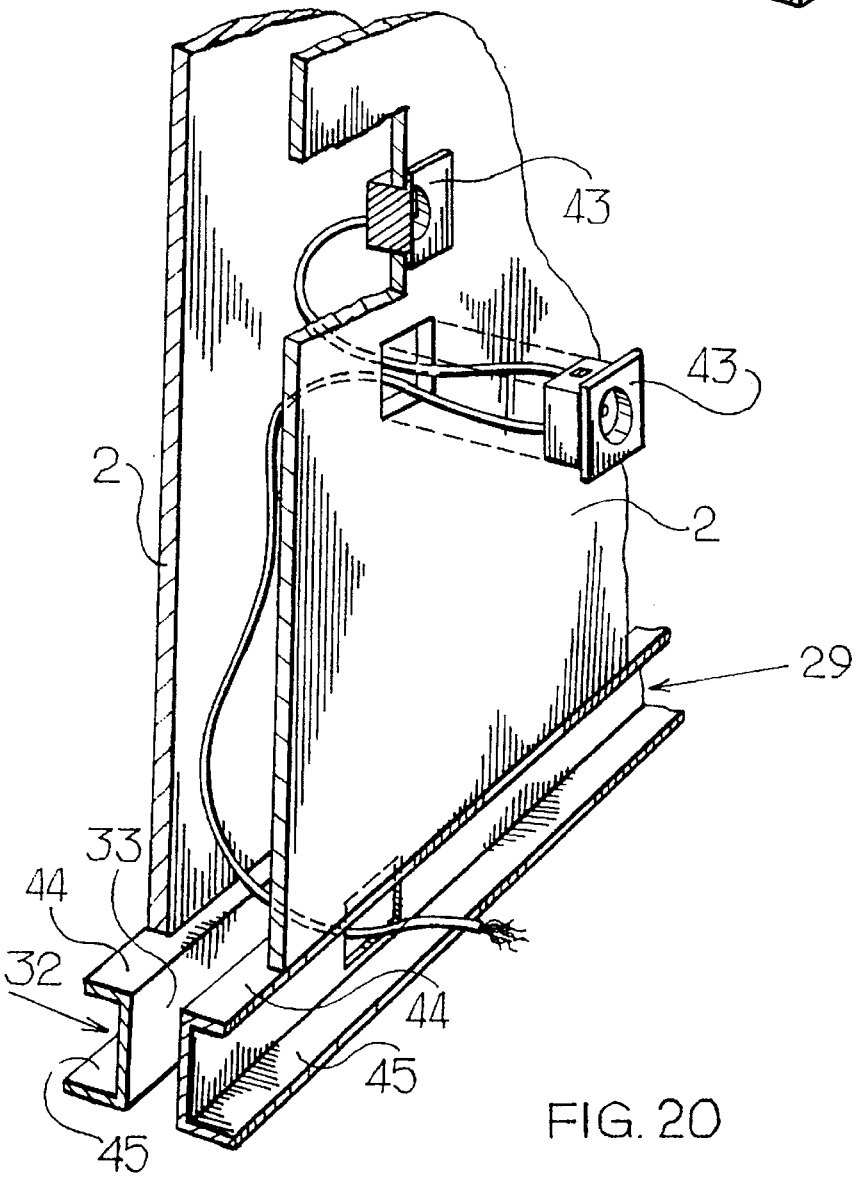
FIG. 20 shows a partly cut away sectional perspective view of a third embodiment of this support part.

In order to enable connection of junction boxes 43 for placing in the wall 1 to electrical leads, which are usually arranged in support profiles with an upper and lower flange 44 respectively 45, between which a cover (not shown) is then arranged, support profile 32 can be at least partially open on its upper side 33 (FIG. 19 and 20).

Instead of the shown and described snap connections other connections can also be used. All that is important is that the connection can be formed from outside and can be released again without too great an effort and without damage to the panels.

Although the connecting stile consisting of parts releasably connected to each other is described above in conjunction with panels with a recess lying at a constant distance from the visible side, it will be apparent to a skilled person that such a connecting stile can also be applied in other situations.

It will be further apparent to a skilled person that the different support parts 29 described in this application can also be employed in wall systems other than as described above.

We claim:

1. A system for assembling a wall having at least two opposed panels, each panel having at least one recess running parallel to a visible side thereof, said system comprising:

at least one stile for mutually connecting the panels, said stile comprising a plurality of substantially L-shaped stile parts, wherein each of said stile parts has a first leg configured to engage the recess of one of the panels and a second leg carrying first coupling means; and at least two connecting elements, each connecting element comprising a body plate having a plurality of second coupling means configured to engage said first coupling means, wherein the second coupling means of each connecting element are oppositely arranged, and wherein a length of each connecting element is smaller than a length of the stile parts whereby at least one space is formed in the wall between said connecting elements and said stile parts of opposed wall panels.

2. The system as claimed in claim 1, wherein said first coupling means comprise a first chamfered hook portion arranged at an edge of said second leg of each said stile part and extending outside a plane thereof, and wherein said second coupling means comprise a second chamfered hook portion having a first end attached to said body plate and a free end directed toward an adjacent stile part, the shape of said second chamfered hook portion substantially corresponding to that of said first hook portion.

3. The system as claimed in claim 1, further including channel members arranged along at least one of a floor and a ceiling of a room and extending along the panels, the width of each channel member corresponding substantially to that of said connecting elements, and at least one of said connecting elements being slidable along said stile parts in lengthwise direction of the recesses and configured to fit into the corresponding channel member.

4. The system as claimed in claim 1, wherein said first leg of each L-shaped stile part comprises means for fixing that stile part in lengthwise direction in the corresponding recess.

5. The system as claimed in claim 4, wherein said fixing means comprise at least one gripping part protruding from said first leg.

6. The system as claimed in claim 4, wherein said fixing means comprise at least one opening arranged in said first leg and an adhesive bridge extending therethrough adapted to connect opposite located sidewalls of the recess.

7. The system as claimed in claim 1, wherein at least one of said stile parts has an upper half and a lower half, the length of each of which is at most equal to half the height of a standard room.

8. The system as claimed in claim 7, wherein said stile comprises at least an upper, a lower and a middle connecting element, said middle connecting element having a body part carrying at least two sets of coupling means spaced in lengthwise direction of the recess, at least one of said sets co-acting with the upper half of said stile parts and at least one other set co-acting with the lower half of said stile parts.

9. The system as claimed in claim 8, wherein each stile part has at least two fastening ridges, the mutual spacing of which corresponds substantially to the height of the middle connecting element.

10. The system as claimed in claim 1, wherein each connecting element has at least one guide strip and at least one of said stile parts is provided with a guide portion co-acting therewith.

11. The system as claimed in claim 1, further including at least one support part arranged on an under side of at least one of the panels.

12. The system as claimed in claim 11, wherein said support part is adjustable in at least one of height and direction.

13. The system as claimed in claim 11, wherein said support part comprises a profile having an upper side which is at least partially open.

14. A method of assembling a wall of a desired wall thickness from at least two opposed panels each having at least one recess running substantially parallel to a visible side thereof, comprising the steps of:

arranging a first leg of at least one substantially L-shaped stile part in each recess;

snapping a second leg of each said stile part into a connecting element for mutually connecting said stile parts and thereby the wall panels; and spacing said connecting elements from each other in lengthwise direction of the recess such that at least one space is formed in the assembled wall between said connecting elements and said stile parts of opposed panels.

15. The method as claimed in claim 14, further including the steps of:

arranging at least one channel member along at least one of a floor and a ceiling of a room, said channel member having a width corresponding substantially to that of said connecting elements;

connecting at least one of said connecting elements to at least one of said stile parts; and sliding said connected connecting element along said stile part to which it is connected into said channel member whereby the wall is fixed to at least one of the floor and the ceiling of the room.

16. The method as claimed in claim 14, wherein at least one of said stile parts has an upper half and a lower half, the length of each of which is at most equal to half the height of a standard room, and including the steps of:

arranging said first leg of said upper half of said at least one stile part in the recess;

arranging said first leg of said lower half of said at least one stile part in the recess such that an interspace is formed between said upper and lower stile parts; and connecting said upper and lower halves by arranging therebetween another connecting element bridging the interspace.

17. The method as claimed in claim 14, including permanently fixing said first leg of each said stile part in the recess.

18. The method as claimed in claim 14, including:

determining a desired wall thickness;

choosing the dimensions of said stile in a wall thickness direction; and arranging the recesses at a distance D from a visible side of the panels such that the dimensions of a step between adjacent wall panels at the location of said joint correspond substantially to the manufacturing tolerances of the stile.

19. The method as claimed in claim 14, including arranging the recesses by a machining operation and placing a visible side of each panel against a support member of a machining device to serve at a reference plane during machining.

20. The method as claimed in claim 14, including raising the panels to a desired height above a floor before connection and arranging at least one support part in a space between the panels and the floor.

21. The method as claimed in claim 14, including moving the panels during connecting of the stile parts such that head end sides of the panels are held free of each other.

* * * * *

UNITED STATES PATENT AND TRADEMARK OFFICE

CERTIFICATE OF CORRECTION

PATENT NO. : 5,653,076

DATED : August 5, 1997

INVENTOR(S) : Nicolaas J. Habraken et al.

It is certified that error appears in the above-indentified patent and that said Letters Patent is hereby corrected as shown below:

Column 1 Line 25 "required" should read --requires--.

Claim 19 Column 10 Line 24 "claimed in claim 14" should read --claimed in claim 18--.

Signed and Sealed this

Ninth Day of December, 1997

*Attest:*

*Attesting Officer*

BRUCE LEHMAN

*Commissioner of Patents and Trademarks*